US008898993B2

(12) United States Patent
Rodgers

(10) Patent No.: US 8,898,993 B2
(45) Date of Patent: Dec. 2, 2014

(54) BRACKET FOR USE IN BUILDING CONSTRUCTION

(71) Applicant: Richard Bradley Rodgers, Indianapolis, IN (US)

(72) Inventor: Richard Bradley Rodgers, Indianapolis, IN (US)

( * ) Notice: Subject to any disclaimer, the term of this patent is extended or adjusted under 35 U.S.C. 154(b) by 0 days.

(21) Appl. No.: 13/941,478

(22) Filed: Jul. 13, 2013

(65) Prior Publication Data

US 2014/0013701 A1 Jan. 16, 2014

Related U.S. Application Data

(60) Provisional application No. 61/671,712, filed on Jul. 14, 2012.

(51) Int. Cl.
*E04B 1/00* (2006.01)
*E04B 1/38* (2006.01)

(52) U.S. Cl.
CPC ..... *E04B 1/38* (2013.01)
USPC ..... 52/702; 52/289

(58) Field of Classification Search
USPC ..... 52/698–702, 289, 299, 650.3, 73
See application file for complete search history.

(56) References Cited

U.S. PATENT DOCUMENTS 4,811,542 A * 3/1989 Jewell ..... 52/745.21
5,201,156 A 4/1993 Newman
5,242,239 A * 9/1993 Hosokawa ..... 403/258
6,397,552 B1 6/2002 Bourque
6,427,391 B1 8/2002 Lyons
6,817,157 B2 11/2004 Bourque
6,945,004 B1 9/2005 Ghiringhelli
7,225,589 B1 * 6/2007 Smith ..... 52/292
7,254,926 B2 8/2007 Eldeen
8,087,207 B2 * 1/2012 Ghiringhelli ..... 52/650.3
8,240,096 B2 * 8/2012 Kim ..... 52/223.14
8,316,992 B2 * 11/2012 Archer ..... 182/87
8,393,117 B2 * 3/2013 Muir ..... 52/97
8,607,515 B2 * 12/2013 Jarvis ..... 52/253
2006/0130414 A1 6/2006 Walther
2007/0094995 A1 * 5/2007 Alyea et al. ..... 52/700
2013/0340358 A1 * 12/2013 Danning ..... 52/126.7
2014/0026515 A1 * 1/2014 Espinosa ..... 52/700

* cited by examiner

*Primary Examiner* — Elizabeth A Plummer
(74) *Attorney, Agent, or Firm* — E. Victor Indiano; Indiano Law Group, LLC

(57) ABSTRACT

A bracket for a building that includes a first building member, a masonry veneer disposed exteriorly of the first building member, and a second building member disposed exteriorly of the masonry veneer. The bracket includes a bracket body having a first portion for being coupled to the first building member and a second outwardly extending portion having a length sufficient to extend to at least about an exterior surface of the masonry veneer. A connector member extends through the bracket member, and at least partially through each of the first and second building members. A connector support extends through the bracket body and includes a sleeve having a passageway for receiving and supporting the connector member, wherein the bracket body and connector support are configured to distribute a load borne by the connector member on the masonry veneer over an area of the bracket body greater than the area of the connector.

16 Claims, 10 Drawing Sheets

BRACKET FOR USE IN BUILDING CONSTRUCTION

PRIORITY STATEMENT

The present invention claims benefit of priority to Rodgers, U.S. provisional patent application No. 61/671,712, that was filed on 14 Jul. 2012 and is fully incorporated herein by reference.

I. TECHNICAL FIELD OF THE INVENTION

The present invention relates to building products, and more particularly to building products for use in connection with coupling building components such as decks, signs, porches and the like that are disposed exteriorly of a building to an interiorly disposed frame member of the building.

II. BACKGROUND

There are many ways to construct buildings. One technique that is very popular for use in residential structures and smaller commercial buildings is a construction technique wherein a wood or metal frame is placed upon a concrete or cinder block foundation. Often, the frame is overlain with both an interior covering layer such as drywall, and an exterior covering layer. A wide variety of exterior covering layer materials can be employed including various sidings, particle board, stucco and masonry.

A highly popular construction technique includes the placement of a masonry veneer over the frame of a building to form the outside surface of the building. This masonry often takes the form of brick or stone type masonry. Masonry exteriors are highly prized, because of their durability, their structural integrity, and their low maintenance.

A building constructed in this manner usually starts with the foundation being prepared. One way in which a foundation can be prepared is to excavate an area of appropriate length, width and depth, and employ concrete forms to enclose the area. Concrete is then poured within the forms to form a slab upon which the remainder of the structure is built.

An alternative foundation creation technique constructs a foundation that is comprised of a wall. This type of foundation is normally employed when a building is built upon either a crawlspace or a basement. In this type of construction, a concrete wall is usually poured, or else one is formed by building a wall of concrete blocks. Prior to the wall being poured or the concrete blocks being stacked, the area contained within the footprint of the house is excavated down to the appropriate depth that will vary depending on whether the house is being built on a crawlspace or basement. A sill plate is then placed on the upper surface of the concrete wall, and a frame is constructed over the pit-like basement or crawlspace.

The frame portion of the structure includes floor joists that extend generally horizontally, and extend across the span of the excavated basement or crawlspace pit. Although a wide variety of floor joist can be used, preferred current practice is to employ engineered floor joists, that have an appearance similar to wooden 1-beams. A main floor decking is then placed upon the upper surface of the floor joist to form the main floor deck. An example of a preferred floor decking material is a plywood sheet. A 2"×4" bottom plate member is usually then placed on its wider surface around the perimeter of the wall to form a perimetral bottom plate. Additional bottom plates may be placed in other areas of the house to define the placement of walls that will ultimately define the rooms of the structure.

Generally vertically extending 2"×4" studs are then nailed to the bottom wall plate and form the wall frame members. The type of studs used for the wall frame members, and the spacing between wall frame members, along with the specifications that must be met by the other various building components discussed above are usually governed by state, local and/or federal building codes and regulations that include both many similarities, and also a high degree of variance.

The exterior of the wall of the house is formed by starting with a perimetrally disposed rim board member that often comprises a 2"×8", 2"×10", 2"×12" or larger that is placed on its smaller edge and is disposed horizontally, so that for example, a 2"×8" rim board would have an 8 inch height, a 2 inch thickness and a length of whatever distance was appropriate. The rim board will typically have an interior facing surface, and an exterior facing surface. The floor joists are nailed to the interior facing surface of the rim board, and the floor decking is coupled to the upper surface of the rim board along with the upper surface of the joists, with the upper surface of the joists preferably being flush with the upper surface of the rim board. The bottom surface of the rim board is coupled to the sill.

The upper surface of a floor decking includes the bottom frame member along with the vertical frame members.

A sheathing layer is typically comprised of a plywood sheet member, such as a ⅜" thick piece of plywood or ½" thick layer of plywood that is nailed to the exteriorly outer surface of the sill, rim board and frame members. The sheathing sheets are generally placed around the exterior surface of all the frame members to form something of an outer frame wall.

In a well constructed building, sheathing paper, such as TYVEK® brand sheathing paper is fixedly coupled to the exterior surface of the sheathing layer to form a moisture barrier. A masonry veneer wall is then built exteriorly of the sheathing paper. Preferably, an air space, such as a one inch air space is left between the exterior surface of the sheathing paper and the interior surface of the masonry or brick. One or more corrugated metal ties can extend between the masonry veneer layer wall and the sheathing material to help hold the masonry veneer wall in an appropriate spaced relation from the sheathing layer.

The masonry veneer is then extended around the appropriate areas of the exteriors of the house. Although many structures include exteriors that are built entirely of masonry materials, some structures include a mixture of masonry along with other materials such as aluminum siding, pressed board and the like.

As used in this application, masonry relates to a material wherein individual units are laid in and bound together by a mortar. Common materials used in masonry veneer construction include such things as brick, stone, marble, granite, travertine, limestone, cast stone, concrete block, glass block, stucco and tile. Of these various materials, the most commonly used is brick.

A brick is a block or a single unit of a ceramic material that is used in masonry construction. Bricks are typically produced in common standard sizes and in bulk quantities. They have generally been regarded as one of the longest lasting and strongest building materials used throughout history.

Typically, bricks are made from dry earth, usually from clay-bearing subsoil. In some cases, such as adobe, the brick is merely dried. More commonly, the clay from which the brick is made is fired in a kiln of some sort to form a true ceramic. Typically, bricks include the following ingredients: silica, alumina, lime, iron oxide and magnesium.

Bricks have been used since at least the time of ancient Greece, with some bricks that have been found that date before 7500 BC. Fired bricks have been in use at least as early as 4500 BC in the Indus Valley of Pakistan and India.

One of the keys for ensuring that a brick structure will be long lasting and durable is to place the brick in the wall in a manner that avoids undue stresses being imposed on the brick that are of the type that will likely cause the brick to break or split. A brick can be split easily through the application of a point force, or a line force, such as with a chisel. To this end, one of the keys that permits masonry structures, including not only brick structures, but stone, limestone structures and the like, to exhibit such strength and durability resides in the use of the mortar that is placed between the particular masonry units. The mortar is important because it helps to spread out the load of force that is induced on the brick by the other brick units within the wall, and thus, prevents those point and line loads of the type that might cause the brick to crack or fissure.

Mortar is a workable paste that is used to bind construction masonry units together and to fill the gaps between them. Although workable while wet, mortar becomes hard when it sits and thereby results in a rigid aggregate structure. Modern mortars are typically made from a mixture of sand, a binder such as cement or lime, and water.

In summary, it is important to disperse the loads and forces imposed upon a masonry veneer in order to ensure its longevity and stability. Unfortunately, there are certain occasions wherein a builder may wish to desire to place a point or line load upon a masonry veneer, of a type, that may cause the masonry veneer to weaken and crumble. Such occasions occur when an outside building member is coupled to the inner building frame by a connector rod, such as a nail, bolt, rod or the like.

Several different types of building structures exist that are disposed exteriorly to the masonry veneer of a building. Such structures include things such as building deck, balconies, wooden porches, staircases and the like.

Many of these external building structures must be securely coupled to the frame of the building, in order to ensure that they will remain stable positioned relative to the building, and to ensure that they will be able to bear the load that they impose on the building, along with the load that they bear. As an example, an outside wooden deck that may be coupled to the house and built exteriorly of the masonry veneer will itself impose a significant load on the structure of the building to which it is attached because of the weight of the wood and the amount of the wood necessary to create the deck. In this regard, a well-constructed wooden deck that is approximately 200 square feet in area may have a total weight of about 12,000 pounds (including live load). Although a large amount of this weight is supported by support posts that extend around the exterior perimeter of the deck, and at various interior portions of the deck, a significant amount of this weight is also borne by the building structure to which the deck is attached.

In addition to the load of the deck itself, an additional load is imposed by the weight of persons, furniture, pets, grills, fireplaces and other items that are placed upon the deck. To stabilize such a deck, and fixedly couple it to the frame of the building, builders will often couple the portion of the deck to an interior frame member of the building structure.

To couple the exterior building structure (herein, for example a wooden deck) to the building structure, the builder first installs a ledger board. A ledger board comprises a thickened board such as a 2×6 inch board, 2×8 inch board, 2×10 inch board or 2×12 inch board that is placed along the exterior surface of the masonry veneer units, and is disposed in a plane parallel generally to the rim board, and is placed at a co-equal height position as the rim board, so that a connector member such as a bolt, rod or nail that is driven through the rim board in a direction perpendicular to the major plane of the rim board will be appropriately positioned to also pass through the ledger board. Deck joists are then coupled to the ledger board so that they extend in a direction generally perpendicular to the major extent of the ledger board.

A connector extends between the rim board and the ledger board to fixedly couple and secure the ledger board to the rim board, and thereby, by extension fixedly couple the deck to the interior frame structure of the building. Because of the construction of the masonry veneer wall, a connector such as a rod that extends between the rim board and the ledger board will also pass through the sheathing, sheathing paper, one inch air space, and masonry veneer in its path between the rim board and the ledger board. In many cases, a thick carriage-type bolt is used that can be tightened to appropriately couple the ledger board to the rim board.

Although the nature of the wood from which the rim board and ledger board and sheathing board are made tend to make these devices wooden boards well suited for withstanding the forces imposed by a cylindrical connector member such as a bolt, the brick or mortar through which the bolt passes is not so well suited to absorb these forces. For that reason, it is often non-code compliant to use connector bolts that extend between the rim board and the ledger board and pass directly through the masonry veneer. As discussed above, the difficulty with the use of such a connector bolt is that the small line load created by such a connector member can deleteriously effect the mortar or brick through which it passes.

It is therefore an object of the present invention to provide a bracket member that will enable a connector to couple an external building structure, such as a deck to a building frame member, such as a rim board and that passes through a masonry veneer that will be less likely to adversely affect the integrity of the masonry veneer through which it passes.

III. SUMMARY OF THE INVENTION

In accordance with the present invention, a bracket is provided for a building that includes a first building member, a masonry veneer disposed exteriorly of the first building member, and a second building member disposed exteriorly of the masonry veneer. The bracket includes a bracket body having a first portion for being coupled to the first building member and a second outwardly extending portion having a length sufficient to extend to at least about an exterior surface of the masonry veneer. A connector member extends through the bracket member, and at least partially through each of the first and second building members. A connector support extends through the bracket body and includes a sleeve having a passageway for receiving and supporting the connector member, wherein the bracket body and connector support are configured to distribute a load borne by the connector member on the masonry veneer over an area of the bracket body.

Preferably, the first bracket portion of the bracket body includes a first surface placeable adjacent to the building surface and the fastener receiving area. Fasteners can extend through the fastener receiving area and pass into the first building member for coupling the bracket to the first building member. The first bracket portion is generally plate-like in configuration and has a length, a width and a height where each of the length and width are greater than the height.

Additionally, the second portion is preferably block-shaped and includes at least two laterally facing walls and at least one outwardly facing wall. The laterally facing walls have a depth sufficient for positioning the outwardly facing wall in an exteriorly exposed position on the masonry veneer. Additionally, the connector support preferably is disposed within the second bracket portion and includes a major plane that extends in a direction generally parallel to the direction in which the primary force is exerted upon the connector. In a most preferred embodiment, the connector support comprises a metal member that is co-molded with the injectable molded plastic from which the remainder of the bracket member is made.

The second bracket portion is preferably sized and configured for insertion into a mortar joint of the masonry veneer. The second bracket portion and connector member are functionally coupled to cause forces exerted on the connector member by the first and second building members to be dispersed on the masonry veneer over an area defined by the laterally facing walls.

One feature of the present invention is that the bracket is insertable through a masonry veneer and is configured and sized so that the surface area of the bracket that contacts the masonry veneer is significantly larger and greater than the surface area of the connector member. This feature has the advantage of dispersing the forces that are exerted on the connector member by the first and second building members over a larger area on the masonry veneer, with this area generally being defined by the walls of the bracket member. This dispersion of forces has the advantage of significantly reducing the likelihood that the connector member will split, crumble or fissure the mortar or masonry member within the masonry veneer, and thereby damage the masonry veneer.

It is also a feature of the present invention that a connector support is preferably made from a metal member that is co-molded with an injection moldable plastic that forms this first and second bracket portions. This feature has the advantage of enabling the device to be both weather resistant, low cost, and strong.

The plastic of the bracket portions makes the device generally inexpensive to manufacture, while making the device resistant to rust and other degradations that may be more common to metal than plastic parts. The metal connector supports, by being made of metal, can be easily made to be strong enough to resist the pressures that are exerted by the connector member on the connector support. Additionally, the use of the metal support can help to make the brackets definitely more rigid and better capable of withstanding forces than the use of the plastic bracket alone.

These and other features of the present invention will become apparent to those skilled in the art upon a review of the drawings and detailed description presented below that are believed by the applicant to disclose the best mode of practicing the invention perceived presently.

These other features of the present invention will become apparent to those skilled in the art upon a review of the detail of the drawings appended hereto, and the detailed description of the drawings presented hereunder.

IV. BRIEF DESCRIPTION OF THE DRAWINGS

V. DETAILED DESCRIPTION OF INVENTION

Figure 1:
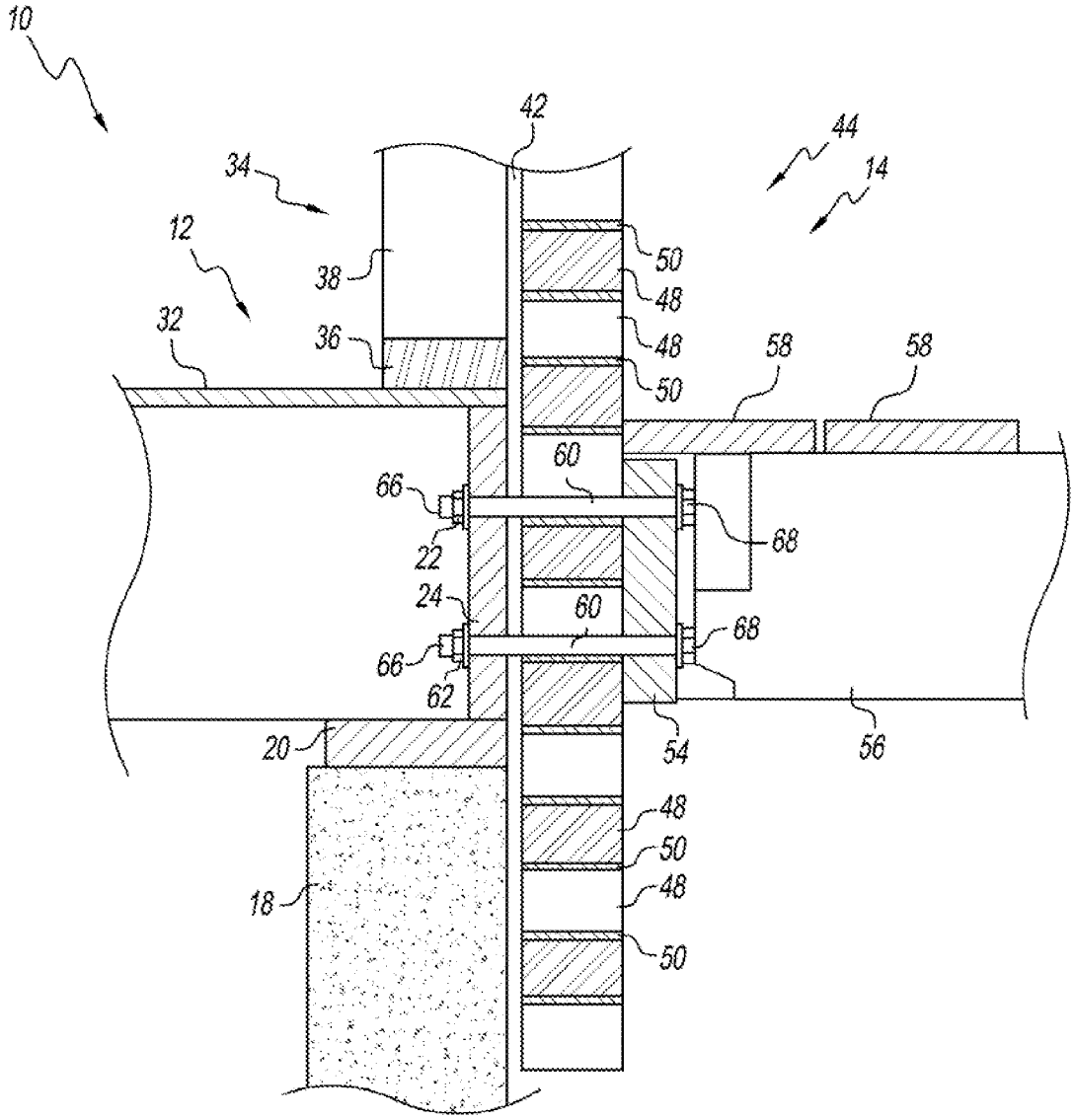
FIG. 1 Prior Art
FIG. 1 is side, schematic view of a prior art coupling system used to couple an interior building member to an exterior building member that includes a bolt type coupling member that extends through a masonry veneer.

Before the present invention is described, it is helpful to review the prior art, so that one can help distinguish the invention from the prior art. To that end, the reader's attention is directed to FIG. 1, wherein a prior art wall and connector system 10 is shown. The prior art wall and connector system include an interior building member 12, that is comprised primarily of the house frame, and an exterior building member 14 that here is shown as a deck. Although the exterior building member 12 is shown as a deck, it will be appreciated that the invention is applicable with a variety of other exterior building members including, but not limited to porches, pergolas, balconies, signs, window boxes and stairs and other exteriorly disposed building components that exert force on the building through their weight and/or have force exerted on them by the weight of other items, such as people, furniture and the like. As will be described in more detail below, a connector apparatus is provided as a part of the wall system 10 that is used to couple the exterior building member 14 to the interior building member 12 so as to support and fixedly position the exterior building member 14 to the building.

The interior building components include a foundation wall 18 that is usually formed from either poured concrete or cinder blocks. In lieu of the foundation wall 18, a foundation slab can serve as the main foundation of the house. A sill plate 20 usually comprises a thickened board, such as a 2"×4", 2"×6", etc., that is placed on top of the foundation wall. A rim board 24 is placed on end on top of the sill plate so that its major width dimension (that is usually 6", 8", 10" or 12") extends vertically, and its thickness dimension extends horizontally. The rim board is preferably a 2"×6", 2"×8", 2"×10" or 2"×12" board.

A flooring system is placed adjacent to and coupled to the rim board 24. The floor system includes a series of floor joists 28 that are usually placed in a parallel spaced arrangement, to extend in a direction generally perpendicular to the extent of the major plane of the foundation wall 18 and also of the rim board 24. Preferably, engineered floor joists 28 are used. Plywood decking 32 is placed over the floor joists and serves as the "sub-floor". Plywood decking typically underlays an exposed floor surface that may be chosen from flooring types such as hardwood flooring, laminate flooring, carpet, tile and the like.

The house framing assembly is placed on top of the plywood floor decking 32. The house framing 34 includes a base frame member 36 that usually comprises a 2"×4" that is laid on its long side, and extends in a perimetral manner around the exterior surface of the housing, in a path generally similar to the path followed by the exterior foundation wall 18. Additionally, internal framing assembly sections exist that are positioned other than at the wall of the house and are used to divide the footprint of the house into rooms, hallways, and other spaces.

In addition to the base frame member 36, the frame includes a plurality of upright frame members such as studs 38 that are usually placed in a spaced relationship, and extend primarily vertically. A capping frame member may be disposed to extend between the upper ends of the upstanding frame member studs 38. An air space 42 is formed between the exteriorly facing surfaces of the frame members 38, and the interior facing surface of the masonry veneer 44.

The masonry veneer 44 is formed to create the exterior surface of the building, and includes a plurality of masonry units, such as bricks 48 that are coupled together by mortar filled joints 50. As shown in FIG. 1, the bricks 48 that form a part of the wall are laterally staggered with respect to each other so that a typical vertical mortar joint only extends the height of a brick, before it is interrupted by the middle of the brick of the next upwardly and next downwardly positioned layer. The masonry veneer 44 is formed into a wall to extend over the entire surface area, or some portion of the surface area of the building, depending upon the whims of the user and the builder. Additionally, as described in the background portion of the invention, a wide variety of different types of masonry units can be employed to form the masonry veneer, with the characteristics, size, shape and other features of these various types of masonry veneer units being generally well known to those in the construction arts.

The external building member 14 assembly is shown as being a deck that includes a series of deck joists 56 that extend generally perpendicular to the major plane of the masonry wall 44, and deck boards 58 that are nailed or screwed on to the upper surfaces of the deck joists 56. The deck boards comprise the upper surface of the deck and the boards 58 form the surface upon which persons walk and furniture is placed.

A ledger board 54 is placed adjacent the exterior surface of the masonry veneer 44 and is positioned so that the major plane of the ledger board 54 extends in a plane that is generally parallel to the plane of the rim board 24. The ledger board 54 and rim board 24 are positioned at about the same vertical position, so that when connector members 60, (here shown as bolts) are extended through the rim board 24, they will be properly positioned to also extend through the ledger board 54 so that the connector member 60 can connect the rim board 24 to the ledger board 54. The ledger board 54 may be a board that is similar to the rim board 24, as it may comprise a board such as a 2"×6", 2"×8", 2"×10" or 2"×12" or the like. The important thing when choosing a ledger board 54 and rim board 24 is that they be strong enough and thick enough to have sufficient structural integrity to withstand the forces imposed upon them by the weight of the building components, and the stresses imposed on them by the connector members 60. For these reasons, it is unlikely that thin, sheet-like materials, such as ¼" or ½" plywood would have the necessary structural rigidity to serve as competent ledger boards 54 or rim boards 24.

A connector member 60 includes first end portions 66 that are disposed interiorly of the rim board 24, such that the end portions 66 extend through the rim board 24. The second end portions 68 of the connector members 60 are disposed exteriorly of the ledger board 54. The connector members 60 may comprise bolts (e.g carriage bolts or other types of bolts or rods) having heads that are placed at the second end 68 and nuts 62 that are placed at the distal or threaded end of the carriage bolt. The bolts can be inserted as shown and tightened with suitable sockets, air wrenches and the like to securely couple the ledger board 54 to the rim board 24, and hence, by extension securely couple the deck to the building frame of the structure.

Figure 2:
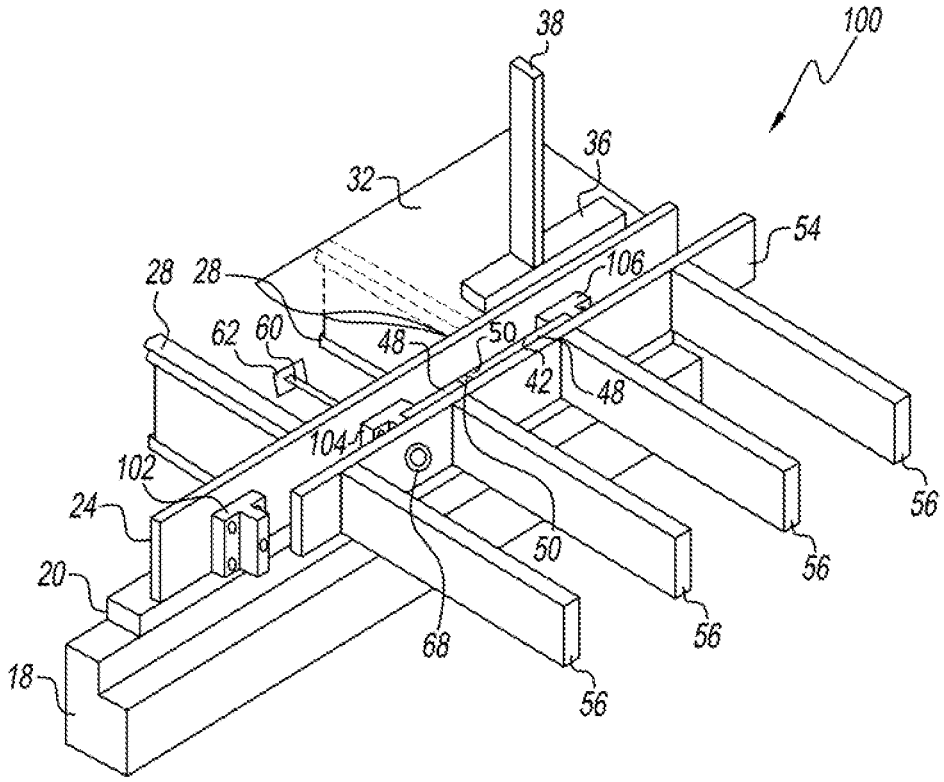
FIG. 2 is a perspective, partly broken view of a portion of a building structure constructed in accordance with the present invention.
Figure 3:
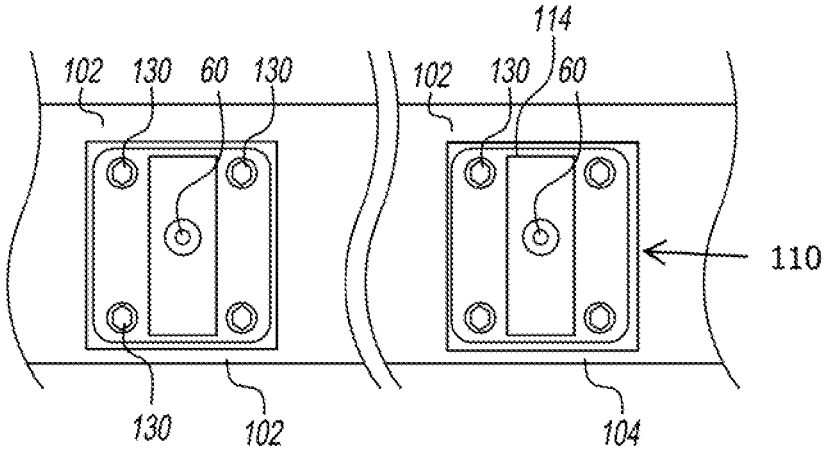
FIG. 3 is a front view of the bracket member of the present invention as attached to a rim board.

A floor and wall and deck system 100 that includes connectors 102, 104, 106 of the present invention is shown in FIG. 2.

For the most part, the manner in which the building frame is constructed and the types and nature of building components that are used in connection with the present invention are similar, if not identical to the building components that are used in connection with the prior art. For this reason, the primary building component (other than the connector bracket 102) that are used in each of the prior art and with the current invention will include similar numbers and names, since the parts are identical.

As shown in FIG. 2, the carryover building component includes such things as the foundation wall 18, the sill board 20, the rim board 24, the floor joist 28, the floor decking 30, the frame assembly including the base frame member 36 and the upright frame members 38, the masonry veneer members including bricks 48 and mortar joint 50, the ledger board 54 and the deck floor joist 56. Additionally, connector members 60 that are generally similar to the connector member 60 shown in FIG. 1 can be employed. However, it will be noted in FIG. 1 that no bracket 102, 104, 106 exists for the prior art, whereas the brackets 102, 104, 106 of the current invention is shown in FIG. 2.

Figure 4:
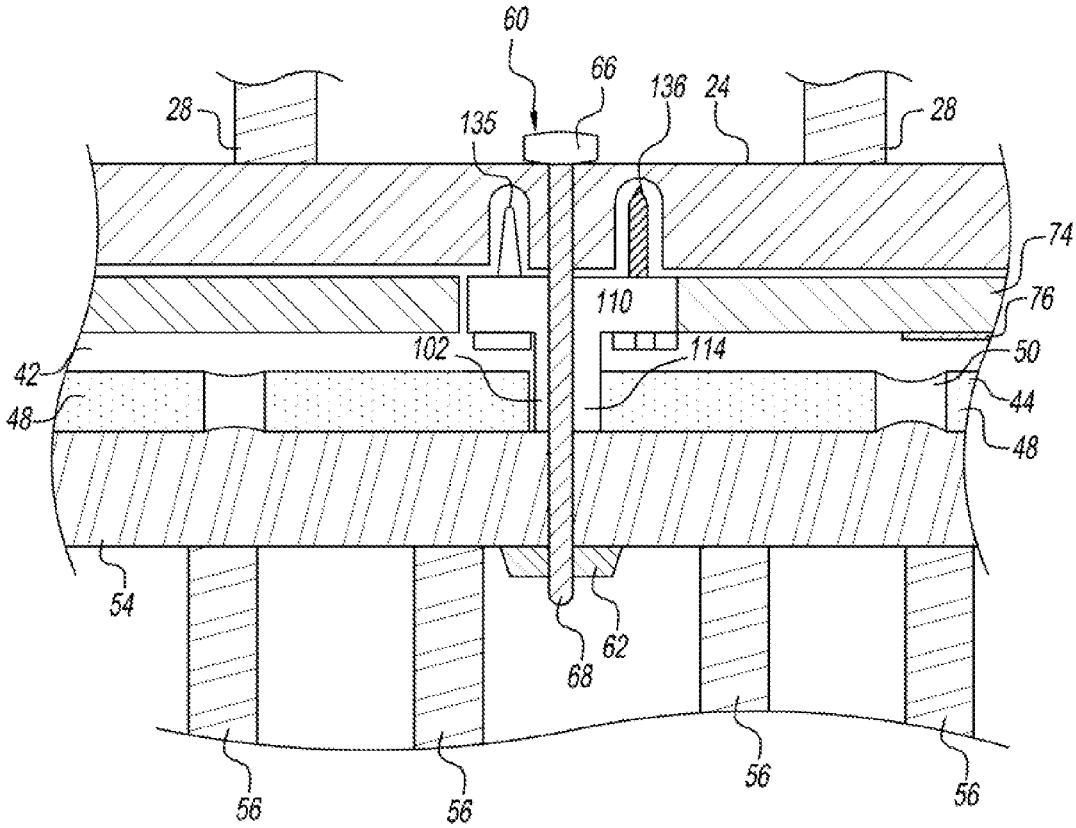
FIG. 4 is a top, sectional view of the connector member of the present invention wherein the bracket is disposed against a rim board and extends through a masonry veneer to a ledger board, to permit a connector member to extend through and engage a rim board and a ledger board of a building.
Figure 5:
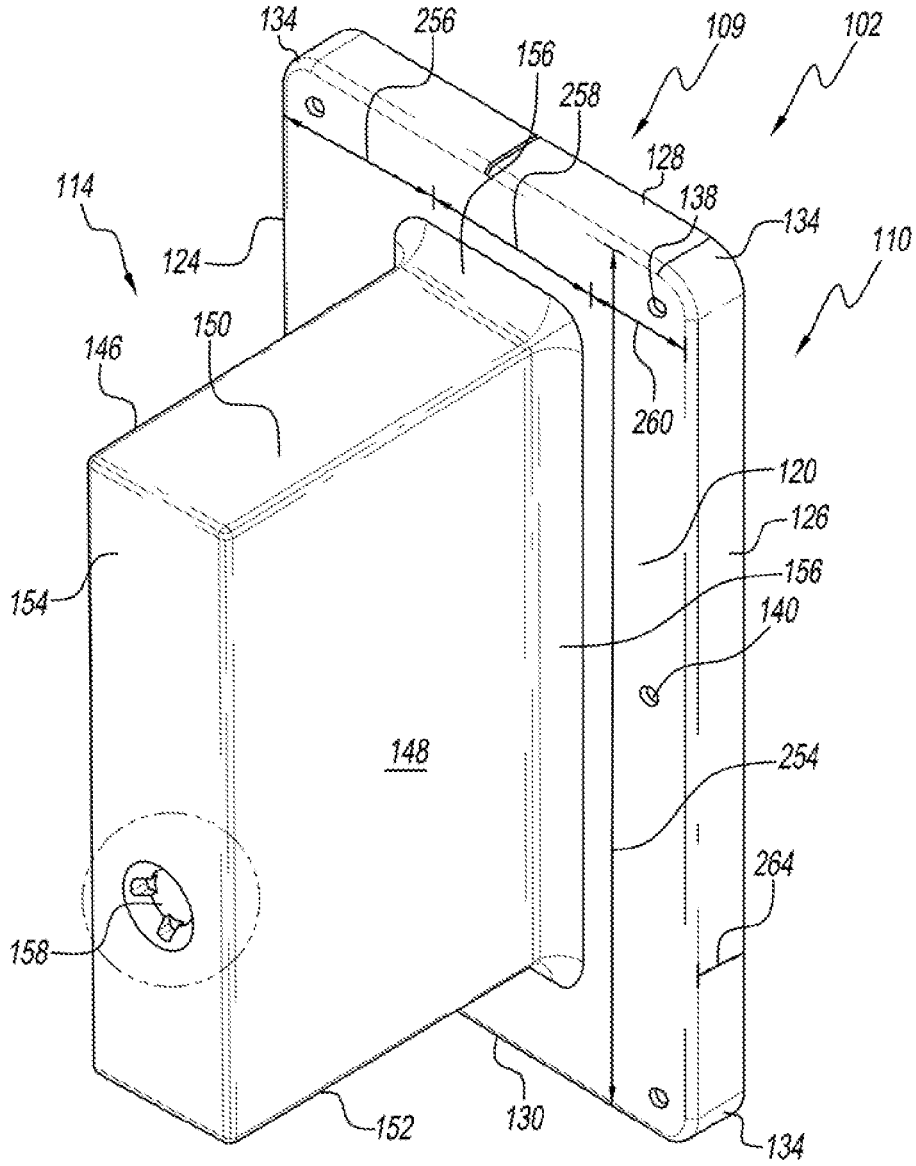
FIG. 5 is a perspective view of the bracket of the present invention.
Figure 6:
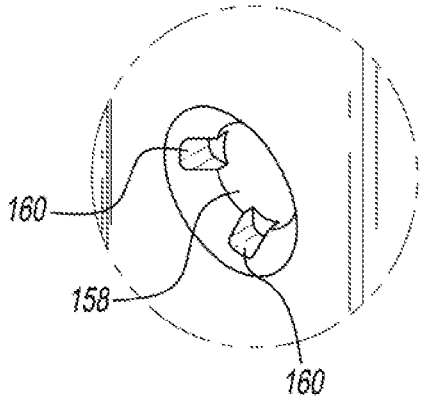
FIG. 6 is an enlarged view of the area encircled by circle D of FIG. 5.
Figure 7:
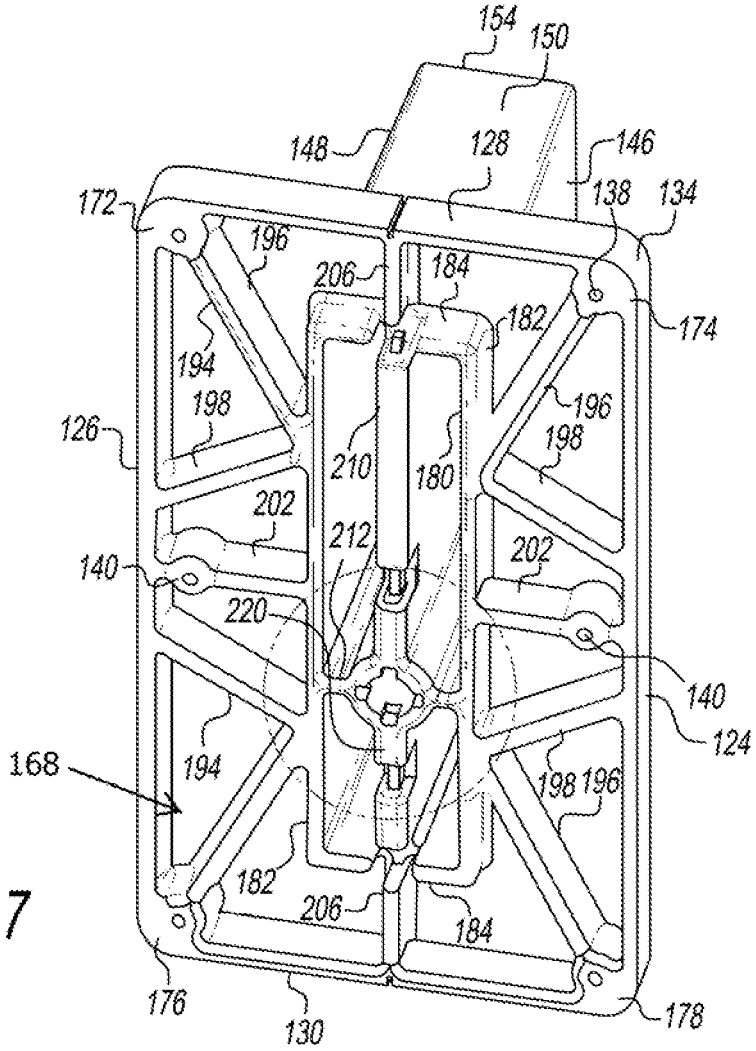
FIG. 7 is a rear perspective view of the first bracket portion side of the bracket of the present invention, showing the side of the bracket that is placed against or adjacent to the rim board.
Figure 8:
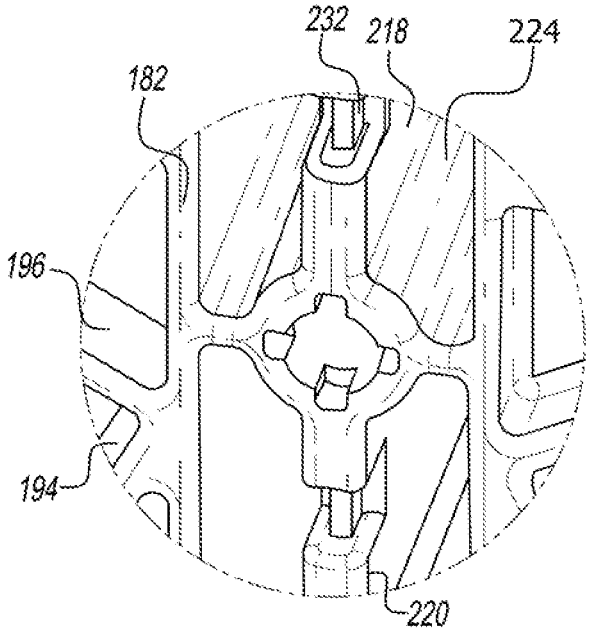
FIG. 8 is an enlarged view of the materials contained within circle C of FIG. 7.
Figure 10:
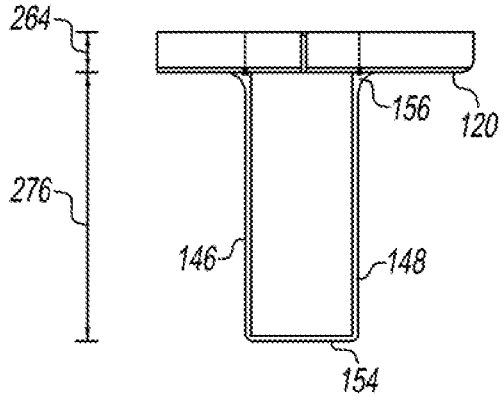
FIG. 10 is a top view of the bracket.
Figure 11:
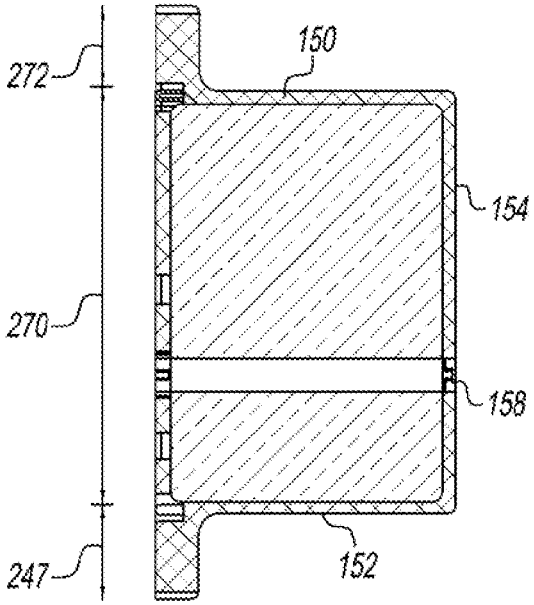
FIG. 11 is a sectional view taken along lines 11-11 of FIG. 9.
Figure 9:
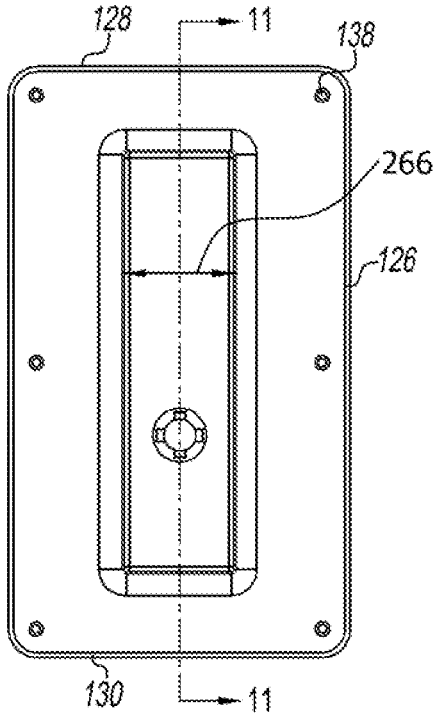
FIG. 9 is a ledger board side view of the bracket of the present invention.
Figure 12:
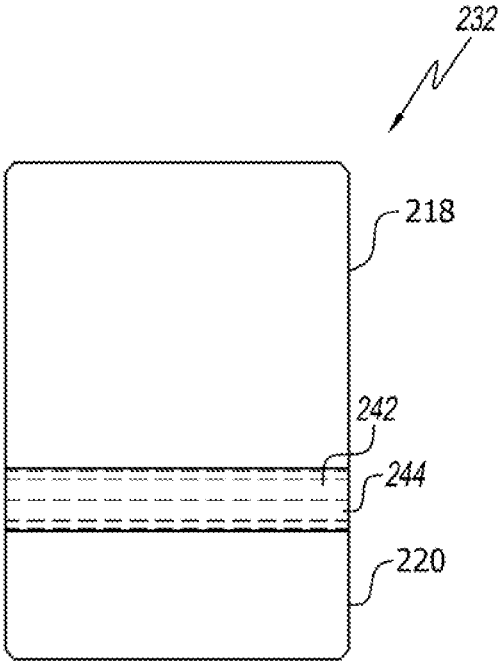
FIG. 12 is a side view of the connector support that is inserted into the bracket of the present invention.

Turning now to FIGS. 2 and 4 the relative position and placement of the brackets 102, 104, 106, etc., are shown in situ within the building wall. In FIGS. 3 and 5-15, the bracket 102 is shown as being removed from the wall.

Turning now to FIG. 4, one feature shown in FIG. 4 is not necessarily shown in FIG. 2 or 1 is the presence of a wall sheath member 74. The wall sheath member 74 preferably comprises a plywood sheet that is placed over the exterior surface of both the rim board 24 and the frame members 36, 38. The sheath member 74 is preferably comprised of plywood sheeting having a thickness of preferably between about ⅜" and ¾" thick. The sheath member 74 serves as a first exterior wall member that is both external to the frame 34, and internal to the masonry veneer 44 of the bricks 48 and mortar joints 50. Additionally, a layer of moisture barrier sheeting 76 is coupled to the exterior surface of the wall sheath 74. The moisture barrier sheeting 76 preferably comprises a material such as Tyvek® brand moisture barrier. TYVEK® is available from E. I. du Pont de Nemours and Company.

The bracket of the present invention will now be described with reference first to the exteriorly disposed feature of the bracket 102 there shown in the figures. Bracket 102 includes a bracket body 109 that is includes a generally plate-like, rectangular first portion 110 that is coupled to a rectangularly cuboid second portion 114. Preferably, the first portion 110 and second portion 114 are unitarily formed in a single molding operation, such that the first and second portions 110, 114 comprise two portions of the same unitary structure. Preferably, for reasons of cost and durability, the bracket body 109 is preferably made from a plastic material.

The first bracket portion 110 as used in this description, refers to the generally thin, plate like portion 110 that is placed adjacent to a rim board 24 of the building frame member, and that generally resides interiorly of the masonry wall 44. In contrast, the second bracket portion 114 comprises the outwardly extending portion 114 that includes a portion that extends through the masonry wall 44, and a portion that is disposed in the air space between the interior surface of the masonry wall 44, and the exterior surface of the wood sheathing 74 and paper sheathing 76.

As will be noted, the plate like first bracket portion 110 is generally rectangular in configuration, and includes a first, long side wall 124, a second long side wall 126, a third short side wall 128 and a fourth short side wall 130. An outwardly facing major planar surface 120 faces outwardly such that when the bracket 102 is positioned within the wall, the outwardly facing major surface 120 faces the interiorly inwardly facing surface of the masonry veneer wall 44. As is shown in FIG. 4, the thickness of the plate portion 110 is generally designed so that it can be somewhat close to the plate thickness of the wall sheath 74 and may, for example, be about 0.75 inches in thickness.

The first portion also includes four rounded corners 134 that join the various side walls 124, 126, 128, 130 together. A series of apertures including four corner apertures 138 and a pair of mid-point apertures 140 are formed in the first portion 110, and extend from front to back of the first bracket section 110. As shown in FIG. 4, the apertures are provided for receiving either nails, such as nail 135, or screw, such as screw 136, for coupling the first bracket portion 110, and hence, the bracket 102 to the rim board 24 of the house frame. The choice of whether to use nails 135 or screws 136 is one of convenience and personal preference, with the various characteristics of each nails 135 and screws 136 being well known in the building construction arts.

As will be discussed in more detail below, the corner apertures 138 and mid-point apertures 140 are placed in thickened areas of the back portion 110 to provide additional structural rigidity and reinforcement to the nails and/or screws to help maintain the nails and screws in the bracket, and to resist the nails and screws causing the bracket 102 to tear.

The second portion 114 includes a series of generally outwardly extending, lateral walls 147, 148, 150, 152 that include a first major lateral wall 146, a second major lateral wall 148, a third minor lateral wall 150 and a fourth minor lateral wall 152. Each of the four lateral walls 147, 148, 150, 152 are generally rectangular in configuration, and are coupled at their outward ends to an outwardly facing wall 154. The lateral walls 147, 148, 150, 152 and outwardly facing walls 154 together form a generally rectangular cuboid section, that joins the first portion 110 at an arcuately circumferential joinder portion 156, that extends between the lateral walls 147 148, 150, 152 at the outwardly facing planar surface 120 of the first portion 110.

The first and second lateral walls 144, 148 are major lateral walls since they have a generally larger surface area than the third and fourth minor lateral walls 150, 152. The first and second lateral walls 146, 148 are disposed in generally parallel planes that are spaced apart by the length of the minor lateral walls 150, 152. Each of the first and second lateral walls are disposed in a plane that is generally perpendicular to each of the major planes of the third and fourth minor lateral walls 150, 152 and the outwardly facing wall 154.

As shown in the other drawings, the normal positioning of the bracket is such that the second portion 114 is inserted into a mortar joint between a pair of adjacent bricks. The first and second major lateral walls are generally disposed adjacent to the sides of the bricks that are disposed on either side of the bracket 102. As such, the typical orientation is that the lateral walls face outwardly to the side, whereas the first and second minor walls 150, 152 face up and down. Viewed another way, during a typical installation, the bracket has a "short edge" on the top and bottom, and a "long edge" on the first and second sides, similar to the orientation shown in FIG. 5.

The third and fourth minor walls 150, 152 are disposed in planes that are generally parallel to each other 150, 152. However, the third and fourth minor walls 150, 152 are also disposed in a planes that are generally perpendicular to the first and second major lateral walls 146, 148; and are disposed also in planes that are generally perpendicular to the outwardly facing end wall 154. The length of the lateral walls 144, 152 should be such that the bracket 102 when installed, can place the outwardly facing wall 154 in a position, such as is shown in FIG. 4 wherein the outwardly facing wall 154 is exteriorly exposed on the exterior surface of the masonry veneer 44, so that it can be placed adjacent to the ledger board 54 that is placed adjacent to the exterior surface of the masonry wall 44. All this occurs, while the rear surface of the bracket 152 is positioned adjacent to the outwardly facing surface of the rim board 24.

The outwardly facing wall 154 comprises the outwardly facing surface of the bracket 102 and includes an aperture 158. Aperture 158 is a connector member receiving aperture, and is sized and configured for receiving the connector member 60 that extends through the bracket, and connects the inner rim board 24 with the outer ledger board 54. The aperture 158 is counter sunk, and includes one or more slots 160 that are disposed radially outwardly of the aperture itself. The slots 160 are provided for helping to maintain the proper position of the metal connector support during the insert molding process. Silicon can be inserted into the area around the connector member 60, for creating a moisture barrier to help keep moisture from traveling through the passageway of the connector member support (discussed below), and thereby causing water originated degradation to any of the building components.

The reverse, or rim board facing side of the bracket 102 will now be described with particular reference to FIGS. 7 and 8 and 12-15, that best illustrate the device.

The outwardly facing planar surface of the first portion, when coupled to the hollowness of the second portion generally result in a hollow interior 168 when viewed from the rim board side of the device 102.

The hollow interior 168 includes a plurality of strengthening ribs that extend throughout the depth of the device, and extend in a variety of directions. These plurality of ribs give structural strength and rigidity to the bracket 102, while reducing the quantity of plastic required and thereby reducing the weight of the device 102, when compared to creating a solid device.

The primary thickened rib comprises the exterior perimetral wall formed of side edges 124, 126, 128, 130, that are relatively thickened and extend throughout the entire depth of the bracket 102. It should also be noted that the corner portions are thickened to provide thickened and reinforced corners 172, 174, 176, 178. The corner apertures 138 are formed in the thickened corner portions, which provides a better anchor for the nail or screw that is inserted therein, and provides resistance to the plastic of the bracket body tearing at the point of insertion and attachment of a nail or screw to the rim board.

Four strengthening ribs are formed together in a box like structure and are disposed at the area generally where the first bracket portion 110 meets the second bracket portion 114. The box forming ribs include first and second parallel long ribs 182 that extend parallel to the longer dimension of the device 102, and a pair of transverse ribs 184 that extend in a direction generally transverse to the long direction of the bracket 102, and that extend between the long ribs 182 at each end of the long ribs.

At least four diagonal rib sets 194 are provided, with each including a first diagonal rib 196 that extends between a corner portion (e.g. 172, 174, 176, 178) and the longitudinally extending box defining rib 182, 184.

The second diagonal rib 198 extends between the longitudinal box defining rib 182, and one of the respective side walls of the bracket 102. First and second transverse ribs 202 extend generally transverse to the longer dimension of the bracket 102 and are positioned to extend between the side wall 124, 126 of the device, and the longitudinally extending box defining ribs 182 of the device 102. Adjacent to the side walls 124, 126 the transverse ribs 202 include thickened portions for receiving the medial apertures 140, through which a nail or screw can be extended to couple the first portion 110 of the bracket body 109 to the rib board member 24, or other appropriate first building member.

A long axis thickened rib member 210 extends generally along the center of the longer dimension of the middle of the second portion 214 of the bracket 208. A transverse medial thickened rib member 212 extends in a direction generally transversely to the long axis medial rib 210, generally between the two long axis box forming ribs 182. The long axis medial rib 210 extends generally between the two transverse box forming ribs 184 and, in connection with major axis rib members 206, extends effectively along the entire length of the bracket 102.

The major long axis medial box rib 210 differs from other ribs of the device, as it is formed not only of plastic, but also of a central metal connector support member that is formed as a part of a box rib 210. The connector support member 232 is formed as a part of rib 210 through a co-molding process wherein the connector support member 232 is formed of metal, and then placed within the mold cavity into which the bracket body 203 is to be molded. The mold is configured so that plastic is placed within the mold cavity and form a device, such that upon the release of the mold cavities, the design shown in the drawings and described herein emerges with the connector support member 232 being encased within the plastic of the long axis rib member 210.

Figure 13:
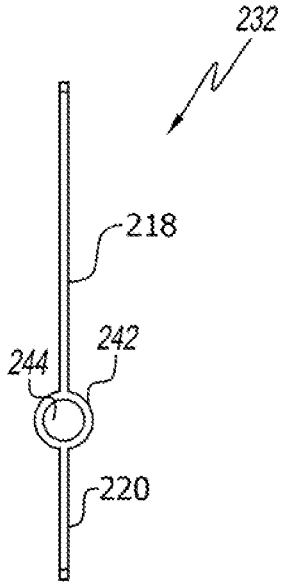
FIG. 13 is an end view of the bracket support shown in FIG. 12.
Figure 14:
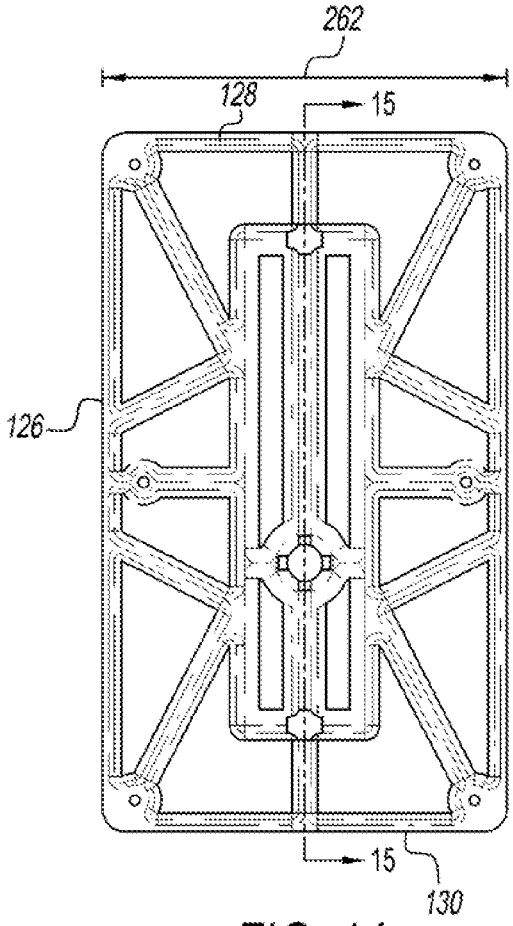
FIG. 14 is a rim board side view of the bracket of the present invention.
Figure 15:
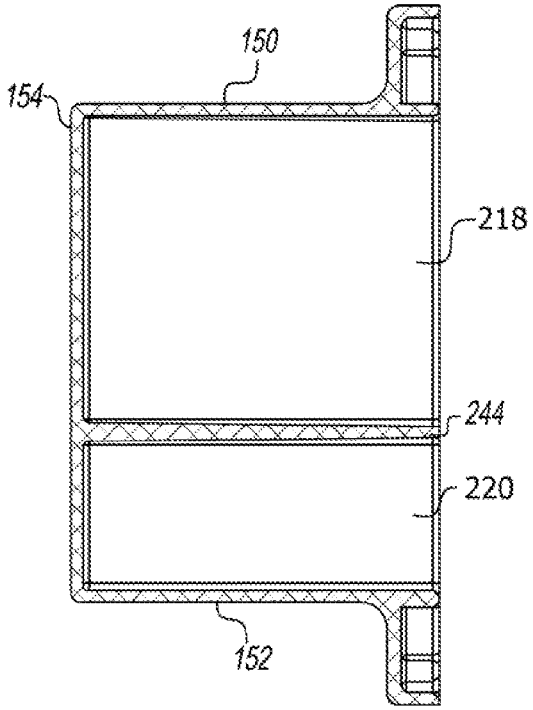
FIG. 15 is a sectional view taken along lines 15-15 of FIG. 14.
Figure 16:
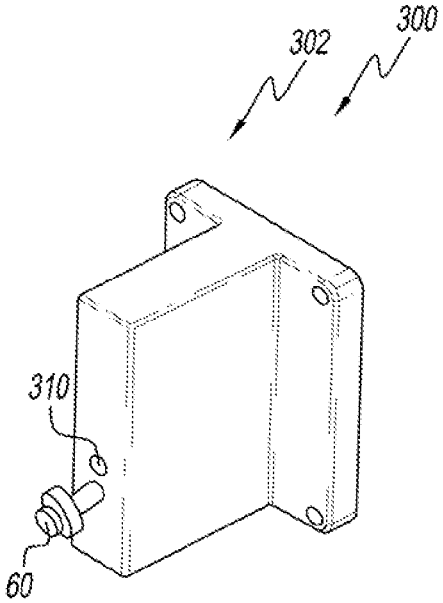
FIG. 16 is a ledger board side oriented perspective view of a first alternate embodiment of the present invention.
Figure 17:
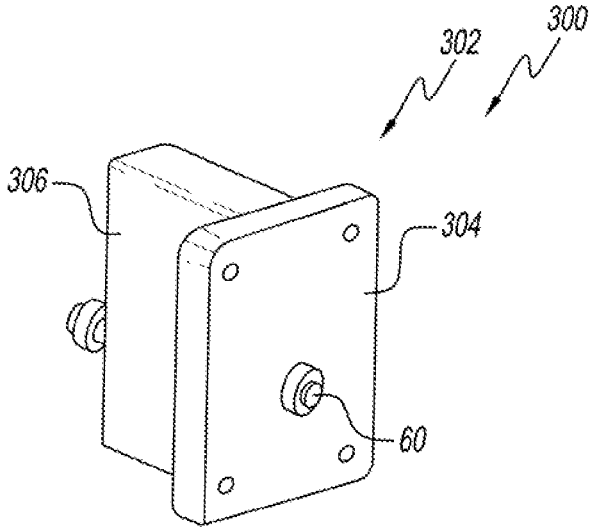
FIG. 17 is a rim board facing perspective view of the first alternate embodiment bracket shown in FIG. 16.
Figure 18:
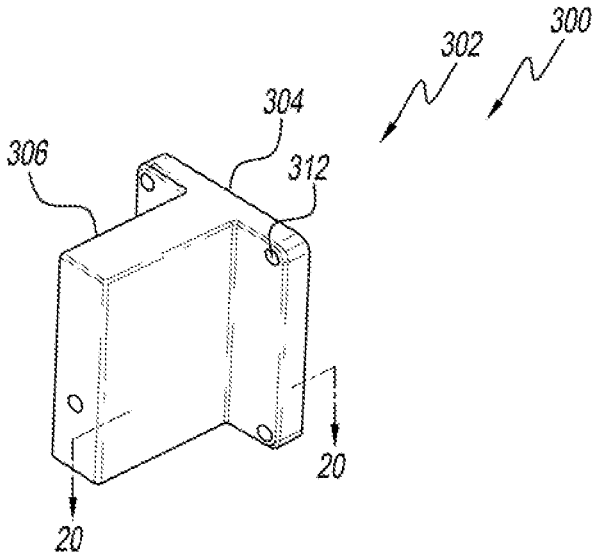
FIG. 18 is a perspective view of the first alternate embodiment bracket of the present invention.

The connector support member 232 is best shown in FIGS. 13 and 14 as being primarily planar in configuration and including a planar, sheet like major planar portion 218, and a sheath like minor planar portion 220, with the major and minor planar portions 218, 220 being disposed in a co-planar manner. A generally tubular connector support receiving section 224 is disposed between the major 218 and minor 220 planar portions, and includes an interior passageway 242 that is sized and positioned for receiving a generally tubular bowl or rod-like connector such as connector member 60.

This invention is not to be limited to an particular sized device, it will be appreciated that the size of the device might vary significantly depending upon such factors as the particular type of masonry used, the thickness of the masonry veneer, the total size of the structure in which the bracket is being used and other factors. Nevertheless, the reader's attention is directed to Table A that sets forth various dimensions. The dimensions set forth in Table A represent the dimensions of a most preferred embodiment, that is useable in connection with conventional sized bricks that are used in connection with a conventional residence or small building. These dimensions are provided for illustration, and not by way of limitation.

TABLE A

Exemplary Dimensions

| Dimension Reference Number | Figure Number | Length (inches) |
|---|---|---|
| 254 | 5 | 10.5 |
| 256 | 5 | 2.0 |
| 258 | 5 | 2.0 |
| 260 | 5 | 2.0 |
| 262 | 14 | 6.0 |
| 264 | 5 | 0.75 |
| 266 | 9 | 2.0 |
| 68 | 11 | 2.0 |
| 270 | 11 | 7.5 |
| 272 | 11 | 1.5 |
| 274 | 11 | 1.5 |
| 276 | 10 | 5.312 |

Your attention is now directed to FIGS. 16-20 wherein a first alternate embodiment bracket 300 is shown. Alternate embodiment bracket 300 has many similarities to bracket 102, insofar as it includes a bracket body 302, a first portion 304, and a second portion 306 that are generally similarly sized, shaped and configured to their respective components of the first bracket 102. The second embodiment also includes a connector support 310 that is sized and positioned for receiving a connector, such as bolt-type connector member 60 in a connector receiving passageway 314. Nail receiving apertures 312 are formed in the first portions 304 to enable the first portion 304 to be nailed or screwed or otherwise fastened with a fastener to a rim board 24, or other appropriate building material member.

Figure 19:
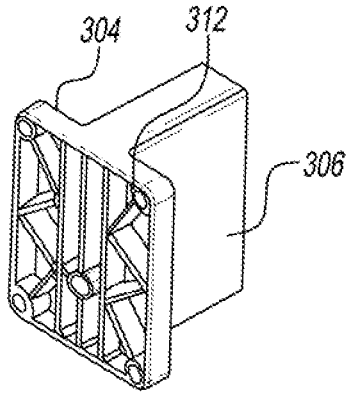
FIG. 19 is a rim board based perspective view of the first alternate embodiment bracket of the present invention.
Figure 20:
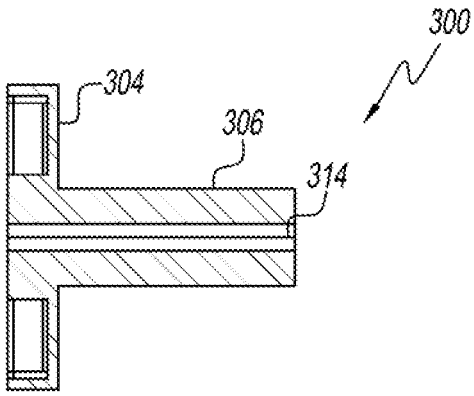
FIG. 20 is a sectional view taken generally along lines 20-20 of FIG. 18.

One difference that will be noticed between the two embodiments is that the rib pattern shown at FIG. 19 of the second embodiment bracket 300 is somewhat different than its correspondent in the first embodiment bracket 102. Another more major difference is that the connector support 310 of the second embodiment 300 does not include an insert molded connector support member 232. Rather, it relies on the molded plastic connector support 310 that is molded into the bracket body 302 as a part thereof.

Having described the invention in detail with referenced certain preferred embodiments, it will be appreciated that the scope and spirit of the invention incorporates modifications, variations and equivalents of the device described herein, and is only limited by the law and the scope of coverage properly accorded the appendant claims.

The invention claimed is:

1. A bracket for a building that includes a first building member, a masonry veneer disposed exteriorly of the first building member, and a second building member disposed exteriorly of the masonry veneer, the bracket including a bracket body having a first bracket portion for being coupled to the first building member, a second outwardly extending bracket portion having a depth sufficient to extend to at least about an exterior surface of the masonry veneer, a connector member for extending through the bracket member, and at least partially through each of the first and second building members and a connector support extending through the bracket body and including a sleeve having a passageway for receiving and supporting the connector member, wherein the first portion of the bracket body includes a first surface placeable adjacent to the first building surface, a fastener receiving area through which fasteners can extend and pass into the first building member for coupling the bracket to the first building member, and a generally hollow interior having a plurality of thickened stiffening ribs, the thickened stiffening ribs including a plurality of generally outwardly extending ribs and box configured thickened stiffening rib members that are positioned generally at a point where the first bracket portion meets the second bracket portion, wherein the thickened stiffening members are disposed in the fastener receiving area, wherein the thickened stiffening ribs include at least two apertures for receiving fasteners for fixedly coupling the bracket to the first building member, and wherein the bracket body and connector support are configured to distribute a load borne by the connector member on the masonry veneer over an area of the bracket body greater than the area of the connector member.

2. The bracket of claim 1 wherein the first bracket portion has a length, a width, and a height wherein each of the length and width are greater than the height.

3. The bracket of claim 1 wherein the thickened stiffening ribs have a depth such that material from which the bracket is made extends substantially the entire depth of the first portion of the bracket body at the stiffening ribs.

4. The bracket of claim 1 wherein the first bracket portion further includes a central portion disposed internally of the fastener receiving portion, wherein the second bracket portion is coupled to the central portion of the first bracket portion, the second bracket portion including an exterior surface and art interior surface defining an interior having hollow areas.

5. The bracket of claim 4 wherein the second bracket portion is generally block shaped, and includes at least two laterally facing walls and at least one outwardly facing wall, wherein the laterally facing walls have a depth sufficient for positioning the outwardly facing wall in an exteriorly exposed position on the masonry veneer.

6. The bracket of claim 5 wherein the at least two laterally facing walls include two sets of laterally facing walls wherein the first set are disposed in planes generally perpendicular to the plane in which the second set are disposed to form a generally rectangularly cuboid shaped second bracket portion.

7. The bracket of claim 6 wherein the bracket is comprised of an injection moldable plastic, and where the first and second bracket portions comprise a unitary bracket body.

8. The bracket of claim 7 wherein the connector support is disposed within the second bracket portion, and includes a major plane that extends in a direction generally parallel to the direction in which a primary force is exerted upon the connector.

9. The bracket of claim 7 wherein the connector support comprises a metal connector support co-molded into the injection moldable plastic bracket body.

10. The bracket of claim 4 wherein the second bracket portion is sized and configured for insertion in a mortar joint of the masonry veneer, wherein the second bracket portion and connector member are functionally coupled to cause forces exerted on the connector member by the first and second building members to be dispersed on the masonry veneer over an area defined by the second bracket portion.

11. The bracket of claim 1 where the second bracket portion is generally block-shaped and includes at least two laterally extending walls and an outwardly facing wall, the at least two laterally extending walls having a length sufficient to position the outwardly facing wall in an exteriorly exposed position on the masonry veneer.

12. The bracket of claim 11 wherein the at least two laterally facing walls include two sets of laterally facing walls wherein the first set are disposed in a plane generally perpendicular to the plane in which the second set are disposed, to form a generally rectangularly cuboid second bracket portion.

13. The bracket of claim 11 wherein the second bracket portion is sized and configured for insertion in a mortar joint of the masonry veneer, wherein the second bracket member and connector portion are functionally coupled to cause forces exerted on the connector member by the first and second building members to be dispersed on the masonry veneer over an area defined by the laterally facing walls.

14. The bracket of claim 13 wherein the first and second bracket portions are comprised of an injection moldable plastic, wherein the first and second bracket portions comprise a unitary bracket body, and wherein the connector support comprises a metal connector support co-molded into the injection moldable plastic of the first and second bracket portion.

15. The bracket of claim 1 wherein the first and second bracket portions are comprised of an injection moldable plastic and wherein the first and second bracket portions comprise a unitary bracket body and wherein the connector support comprises a metal connector support co-molded into the injection moldable plastic of the bracket body.

16. A bracket for a building that includes a first building member, a masonry veneer disposed exteriorly of the first building member, and a second building member disposed exteriorly of the masonry veneer, the bracket including a bracket body having a first bracket portion for being coupled to the first building member, a second outwardly extending bracket portion having a depth sufficient to extend to at least about an exterior surface of the masonry veneer, bracket being comprised of an injection moldable plastic, and the first and second bracket portions comprising a unitary bracket body, a connector member for extending through the bracket member and at least partially through each of the first and second building members and a connector support extending through the bracket body and including a sleeve having a passageway for receiving and supporting the connector member, the connector support being disposed within the second bracket portion, and including a major plane extending in a direction generally parallel to the direction in which a primary force is exerted upon the connector wherein the first portion of the bracket body includes a first surface placeable adjacent to the first building surface and a fastener receiving area through which fasteners can extend and pass into the first building member for coupling the bracket to the first building member, the first bracket portion further including a central portion disposed internally of the fastener receiving portion, the second bracket portion being coupled to the central portion of the first bracket portion and the second bracket portion including an exterior surface and an interior surface defining an interior having hollow areas the second bracket portion being generally block shaped, and including at least two laterally facing walls and at least one outwardly facing wall, the laterally facing walls have a depth sufficient for positioning the outwardly facing wall in an exteriorly exposed position on the masonry veneer, the at least two laterally facing walls including two sets of laterally facing walls wherein the laterally extending walls of the first set are disposed in planes generally perpendicular to the planes in which the laterally extending walls of second set are disposed to form a generally rectangularly cuboid shaped second bracket portion, wherein the connector support includes a first planar portion, a second planar portion and wherein the sleeve is disposed between the first and second planar portions, and the connector support is disposed within the interior of the second bracket portion, and wherein the bracket body and connector support are configured to distribute a load borne by the connector member on the masonry veneer over an area of the bracket body greater than the area of the connector members.

* * * * *